US008473214B2

(12) United States Patent
Gok et al.

(10) Patent No.: US 8,473,214 B2
(45) Date of Patent: Jun. 25, 2013

(54) THICKNESS-INDEPENDENT COMPUTATION OF HORIZONTAL AND VERTICAL PERMEABILITY

(75) Inventors: Ihsan Murat Gok, Istanbul (TR); Peter S. Hegeman, Stafford, TX (US); Mustafa Onur, Istanbul (TR); Fikri John Kuchuk, Meudon (FR)

(73) Assignee: Schlumberger Technology Corporation, Sugar Land, TX (US)

( * ) Notice: Subject to any disclaimer, the term of this patent is extended or adjusted under 35 U.S.C. 154(b) by 319 days.

(21) Appl. No.: 12/758,398

(22) Filed: Apr. 12, 2010

(65) Prior Publication Data

US 2010/0274490 A1 Oct. 28, 2010

Related U.S. Application Data

(60) Provisional application No. 61/172,378, filed on Apr. 24, 2009.

(51) Int. Cl.

| | |
|---|---|
| ***G01N 7/10*** | (2006.01) |
| ***G01N 7/00*** | (2006.01) |
| ***G01N 7/14*** | (2006.01) |
| ***G01F 1/00*** | (2006.01) |

(52) U.S. Cl.

USPC ..... 702/12; 702/11; 702/13; 702/45

(58) Field of Classification Search

USPC ..... 702/4, 11, 12, 47, 179, 182, 183, 702/186; 73/152.18; 166/100; 703/10

See application file for complete search history.

(56) References Cited

U.S. PATENT DOCUMENTS

| | | | | |
|---|---|---|---|---|
| 4,890,487 | A | 1/1990 | Dussan | |
| 5,247,830 | A | 9/1993 | Goode | |
| 5,602,334 | A | 2/1997 | Proett | |
| 7,031,841 | B2 * | 4/2006 | Zazovsky et al. | 702/12 |
| 7,277,796 | B2 * | 10/2007 | Kuchuk et al. | 702/7 |
| 7,290,443 | B2 | 11/2007 | Follini | |
| 7,558,716 | B2 * | 7/2009 | Hammond | 703/10 |
| 8,078,403 | B2 * | 12/2011 | Zhang et al. | 702/11 |
| 2006/0042370 | A1 | 3/2006 | Sheng | |
| 2006/0241867 | A1 | 10/2006 | Kuchuk | |

OTHER PUBLICATIONS

Abbaszadeh, M. and Hegeman, P.S. Sep. 1990. Pressure-Transient Analysis for a Slanted Well in a Reservoir with Vertical Pressure Support. SPEFE 5 (3) : 277-284. SPE-19045-PA. DOI: 10.2118/19045-PA.

Culham, W.E. Dec. 1974. Pressure Build-Up Equations for Spherical Flow Regime Problems. SPEJ 14 (6) : 545-555. SPE-4053-PA. DOI: 10.2118/4053-PA.

(Continued)

*Primary Examiner* — Eliseo Ramos Feliciano
*Assistant Examiner* — Felix Suarez
(74) *Attorney, Agent, or Firm* — Colin Wier

(57) ABSTRACT

A method for determining permeability of a reservoir using a packer-probe formation testing tool. The elements of the method include generating, using a dual packer tool module, fluid flows from the reservoir into a wellbore, obtaining pressure data associated with the fluid flows using an observation probe tool module, wherein the packer-probe formation testing tool comprises the dual packer module and the observation probe tool module, identifying a portion of the pressure data corresponding to a spherical flow regime, determining horizontal permeability based on the portion of the pressure data, and displaying an output generated using the horizontal permeability.

17 Claims, 9 Drawing Sheets

OTHER PUBLICATIONS

Onur, M., Hegeman, P.S., and Kuchuk, F.J. 2004. Pressure-Transient Analysis of Dual Packer-Probe Wireline Formation Testers in Slanted Wells. Paper SPE 90250 presented at the SPE Annual and Technical Conference and Exhibition, Houston, Sep. 26-29, DOI: 10.2118/90250-MS.

Zimmerman, T., McInnis, J., Hoppe, J., Pop, J.J., and Long, T. 1990. Application of Emerging Wireline Formation Technologies. Paper OSEA 90105 presented at the Offshore South East Asia Conference, Singapore, Dec. 4-7.

Onur, "A novel analysis procedure for estimating thickness-independent horizontal and vertical permeabilities from pressure data at an observation probe acquired by packer-probe wireline formation testers", International Petroleum Technology Conference, Doha, Qatar, Dec. 7-9, 2009, IPTC 13912.

The Art of Scientific Computing, Cambridge U. Press, Cambridge, 1986.

Pressure Behavior of the MDT Packer Module and DST in Crossflow-Multilayer Reservoirs,by Kuchuk published in the Journal of Petroleum Science and Engineering, vol. 11, Issue 2. pp. 123-135, published 1994.

Vertical Permeability From Limited Entry Flow Tests in Thick Formationsby Raghavan, et al., published in SPE Journal, 65, vol. 15, No. 1 printed Feb. 1975.

* cited by examiner

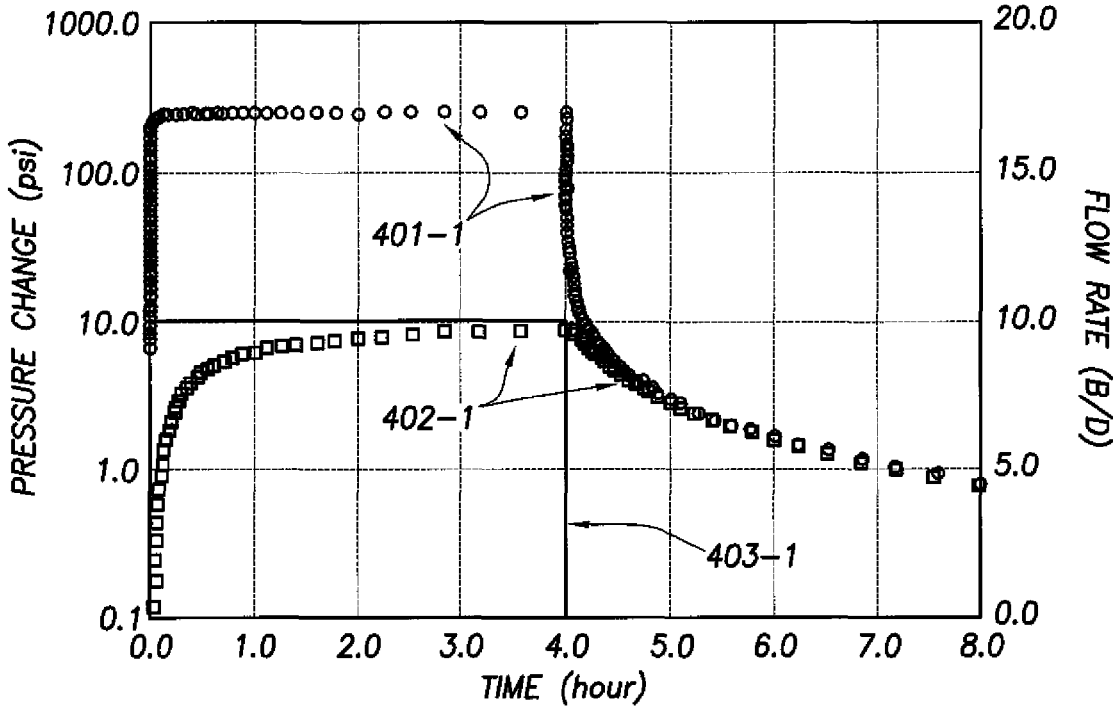
FIG.4.1
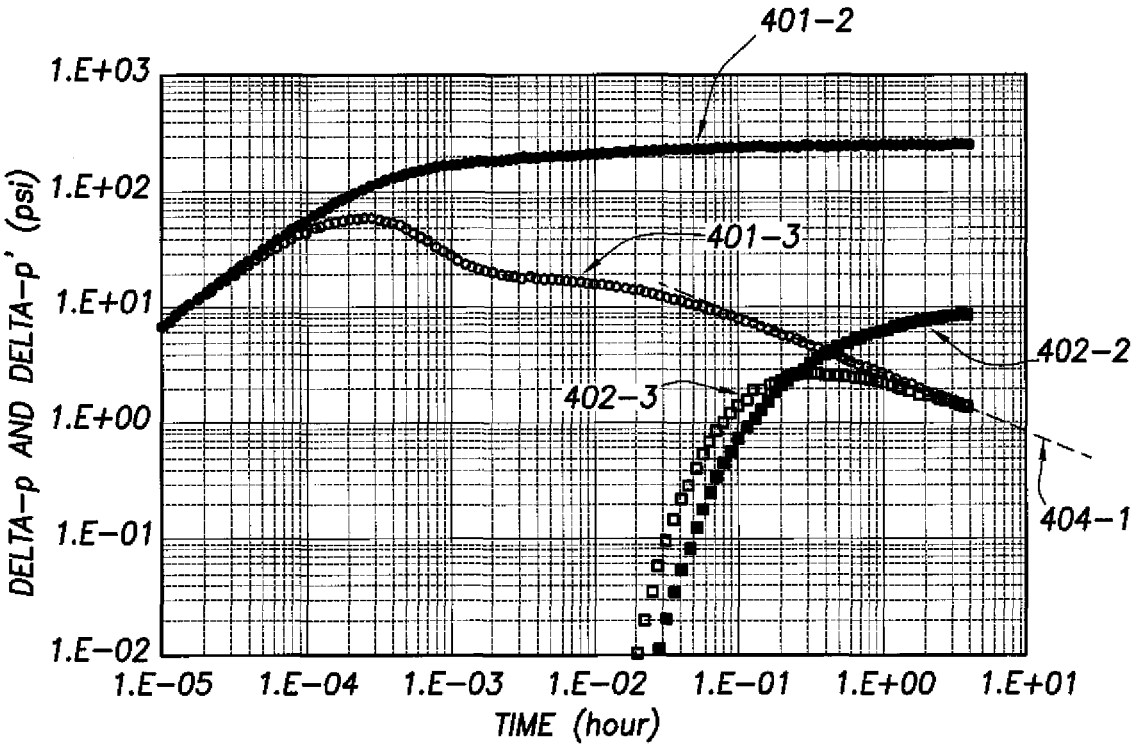
FIG.4.2

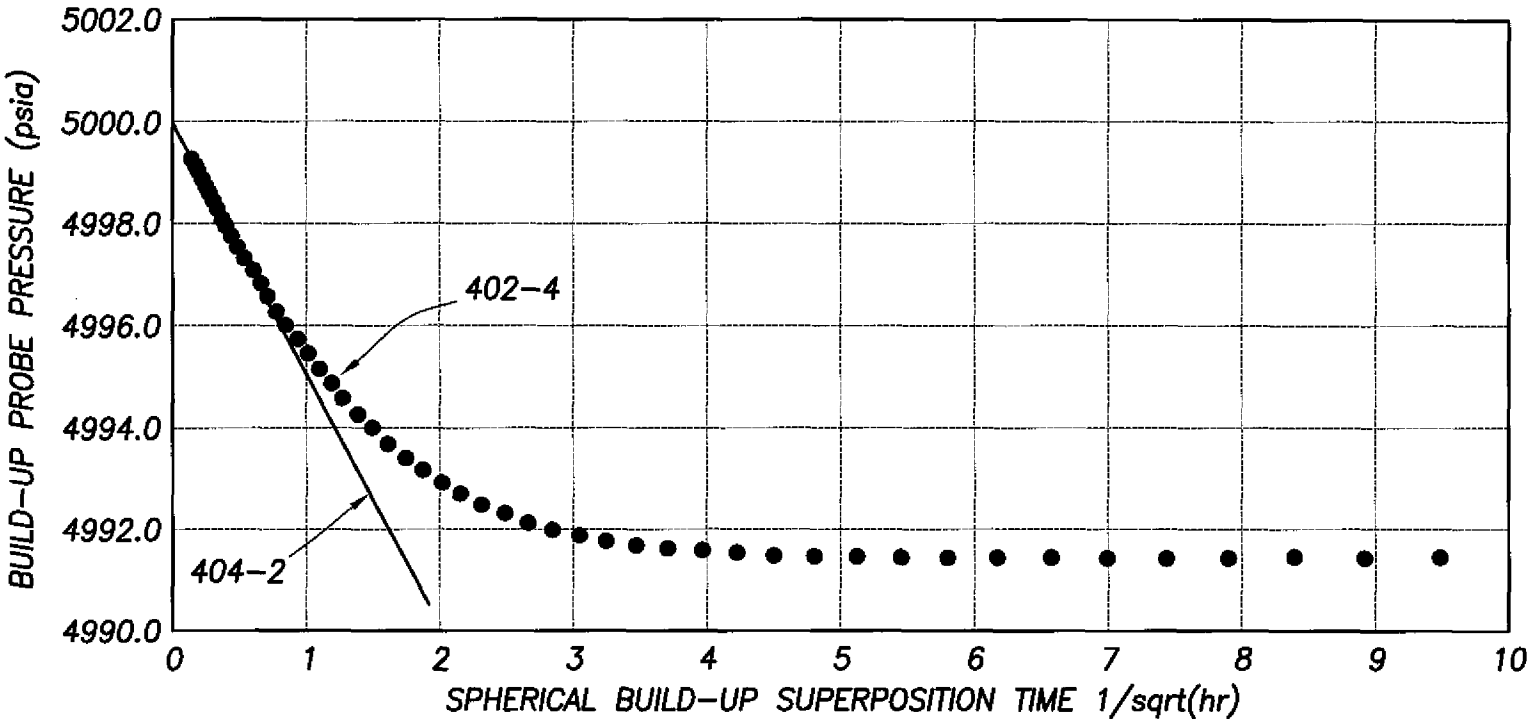
FIG. 4.3

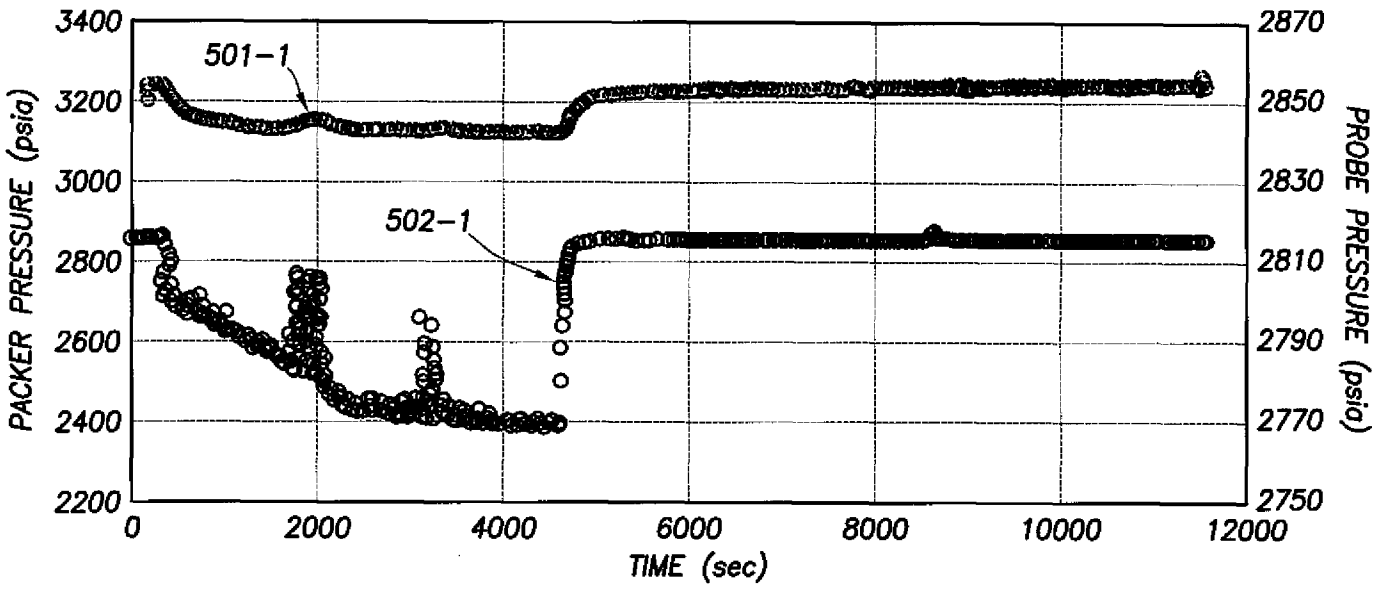
FIG.5.1.1
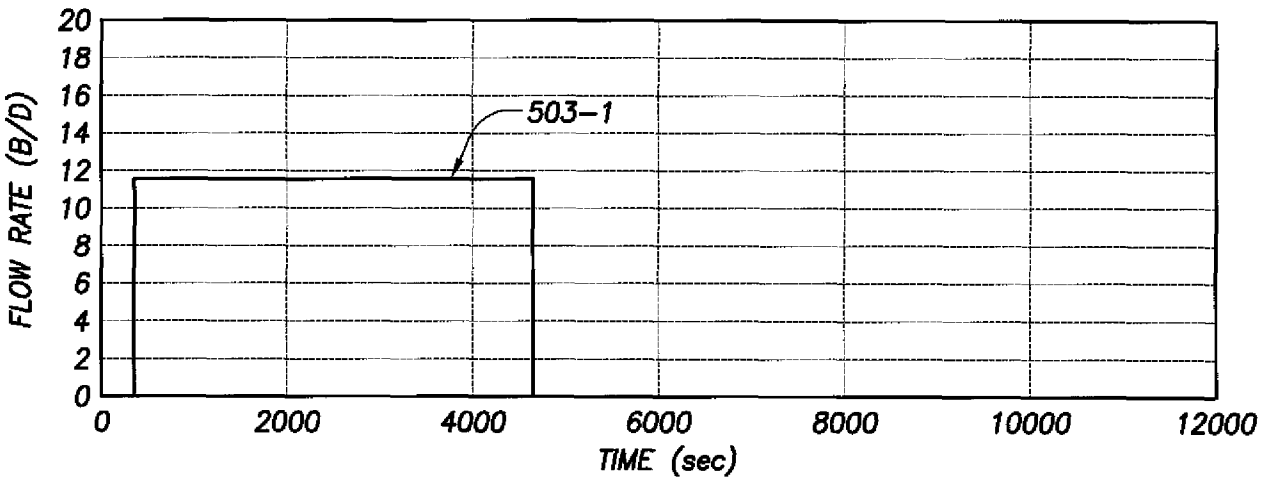
FIG.5.1.2

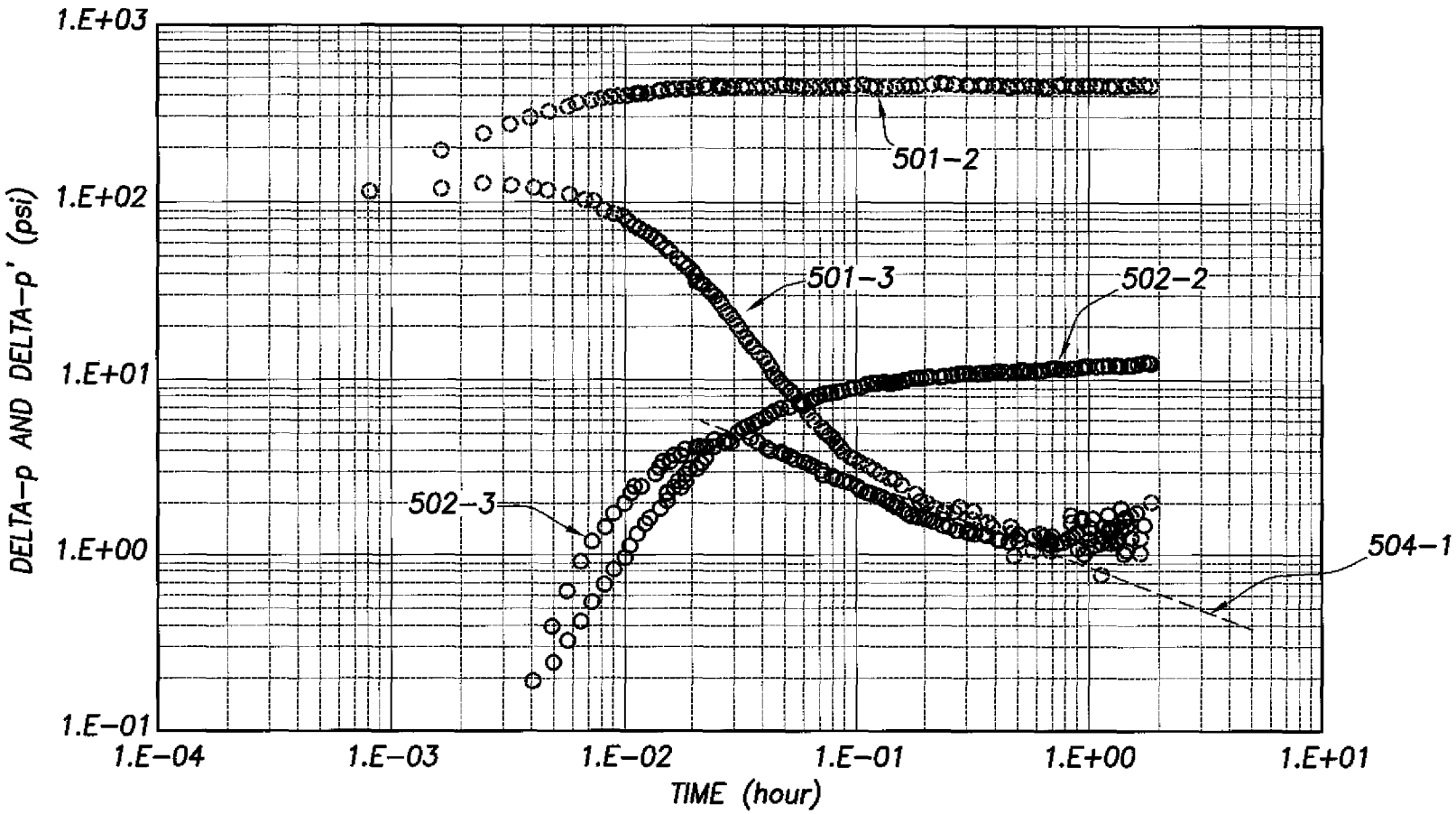
FIG.5.2

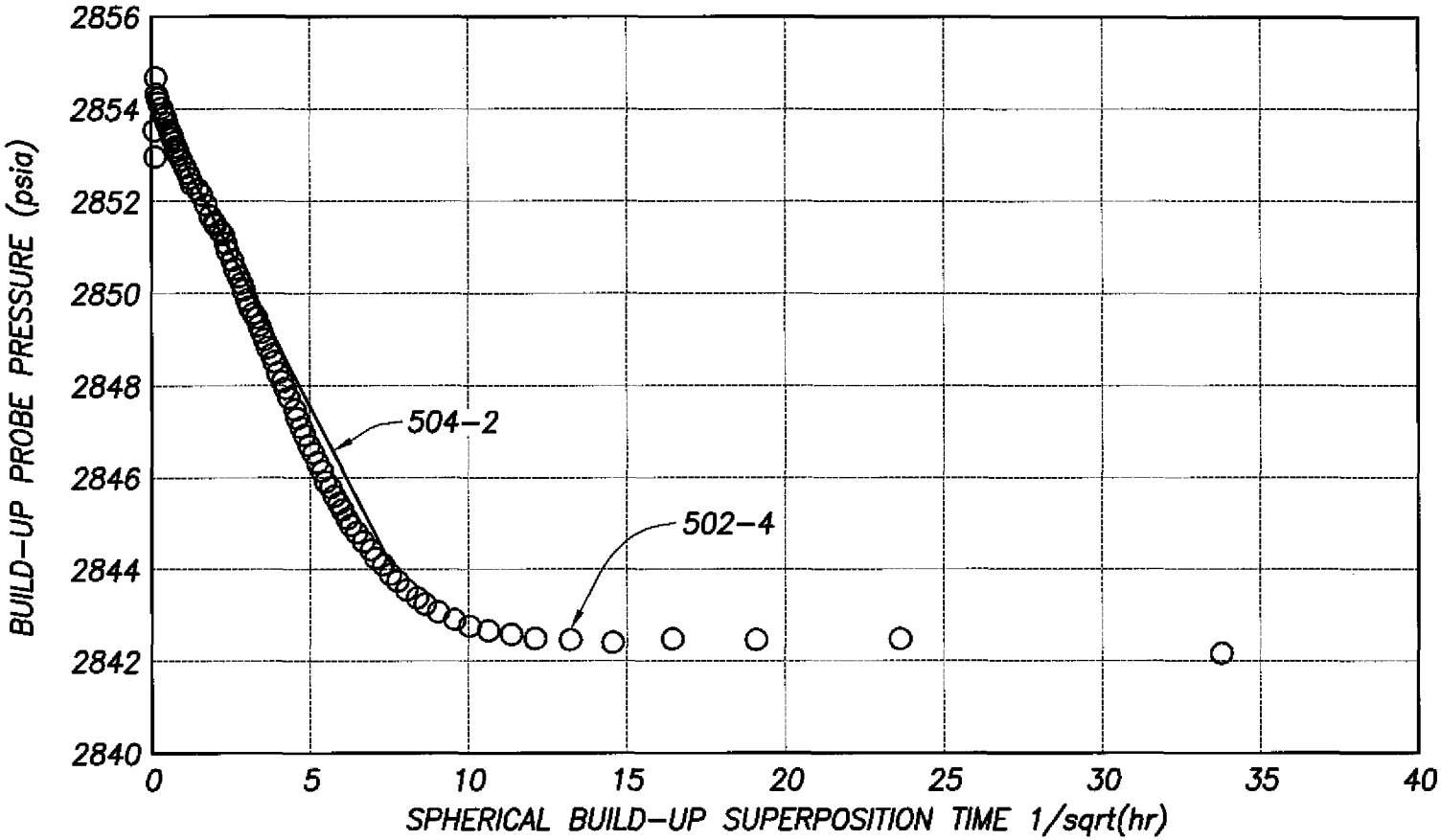
FIG.5.3

THICKNESS-INDEPENDENT COMPUTATION OF HORIZONTAL AND VERTICAL PERMEABILITY

CROSS-REFERENCE TO RELATED APPLICATIONS

This application claims benefit of U.S. Provisional Patent Application No. 61/172,378, filed on Apr. 24, 2009, entitled "METHOD FOR COMPUTATION OF THICKNESS-INDEPENDENT HORIZONTAL AND VERTICAL PERMEABILITY," which is hereby incorporated by reference.

BACKGROUND

Operations, such as surveying, drilling, wireline testing, completions, production, planning and field analysis, are typically performed to locate and gather valuable downhole fluids. Surveys are often performed using acquisition methodologies, such as seismic scanners or surveyors to generate maps of underground formations. These formations are often analyzed to determine the presence of subterranean assets, such as valuable fluids or minerals, or to determine if the formations have characteristics suitable for storing fluids. Although the subterranean assets are not limited to hydrocarbon such as oil, throughout this document, the terms "oilfield" and "oilfield operation" may be used interchangeably with the terms "field" and "field operation" to refer to a field having any types of valuable fluids or minerals and field operations relating to any of such subterranean assets.

During drilling and production operations, data is typically collected for analysis and/or monitoring of the operations. Such data may include, for instance, information regarding subterranean formations, equipment, and historical and/or other data.

Data concerning the subterranean formation is collected using a variety of sources. Such formation data may be static or dynamic. Static data relates to, for instance, formation structure and geological stratigraphy that define geological structures of the subterranean formation. Dynamic data relates to, for instance, fluids flowing through the geologic structures of the subterranean formation over time. Such static and/or dynamic data may be collected to learn more about the formations and the valuable assets contained therein.

Reservoir characterization and asset management require information about formation fluids, reservoir pressure, and flow capacity. Obtaining this information at all stages of the exploration and development cycle is essential for field planning and operation. Understanding vertical flow behavior is also critical for proper reservoir management, especially at the time when completion decisions are made. Wireline formation testing has become quite attractive in the industry as a means to obtain the production potential of the formation before completing the well. Wireline formation testing tools may be used for many formation evaluation objectives, such as pressure profiling, sampling/fluid identification, interval pressure transient testing, and in-situ stress testing.

Permeability is a relevant parameter for managing a reservoir and adjusting well performance. Due to permeability's effect on reservoir displacement processes, the determination of permeability and permeability anisotropy (the ratio of vertical and horizontal permeability, $k_v/k_h$) is becoming increasingly important as emphasis shifts from primary to secondary and tertiary recovery.

Interval pressure transient testing (IPTT) along the wellbore using packer-probe formation testers provides dynamic permeability and anisotropy information with increased vertical resolution as compared to conventional well testing. During IPTT, the test tool is positioned at the interval to be tested and flow is induced from a dual packer tool module or from a sink probe while vertically displaced observation probes monitor the pressure response. The acquired flow and buildup transient data are used to obtain and analyze individual layer horizontal and vertical permeabilities. This testing technique yields formation properties well beyond the invaded zone, usually within "tens of feet" away from the wellbore in horizontal and vertical directions.

Appropriate thickness selection is important in nonlinear regression analysis for parameter estimation in determining horizontal and vertical permeability based on IPTT. However, building a layer cake model is not a trivial process even if high-resolution image-log data is available. Selecting the correct thickness of a formation in IPTT is significantly different as compared to a conventional transient test, where it is generally assumed that thickness is equal to the thickness of the perforated interval. There can be several flow units across the formation and it is not easy to select the correct thickness of the formation. However, if the IPTT is performed in a thick formation, the chance of seeing radial flow is low due to short duration nature of IPTT. In many cases, thickness information and radial flow data may not be available to determine horizontal and vertical permeability using traditional IPTT methods.

SUMMARY

In general, in one aspect, thickness-independent computation of horizontal and vertical permeability relates to a method for determining permeability of a reservoir using a packer-probe formation testing tool. The elements of the method include generating, using a dual packer tool module, fluid flows from the reservoir into a wellbore, obtaining pressure data associated with the fluid flows using an observation probe tool module, wherein the packer-probe formation testing tool comprises the dual packer module and the observation probe tool module, identifying a portion of the pressure data corresponding to a spherical flow regime, determining horizontal permeability based on the portion of the pressure data, and displaying an output generated using the horizontal permeability.

Other aspects of thickness-independent computation of horizontal and vertical permeability will be apparent from the following description and the appended claims.

BRIEF DESCRIPTION OF DRAWINGS

The appended drawings illustrate several embodiments of thickness-independent computation of horizontal and vertical permeability and are not to be considered limiting of its scope, for thickness-independent computation of horizontal and vertical permeability may admit to other equally effective embodiments.

FIGS. 4.1, 4.2, and 4.3 depict example pressure profiles for thickness-independent computation of horizontal and vertical permeability in accordance with one or more embodiments.

FIGS. 5.1, 5.2, and 5.3 depict example pressure profiles for thickness-independent computation of horizontal and vertical permeability in accordance with one or more embodiments. FIG. 5.1 is separated into two portions (as FIGS. 5.1.1 and 5.1.2) for clarity.

DETAILED DESCRIPTION

Figure 1:
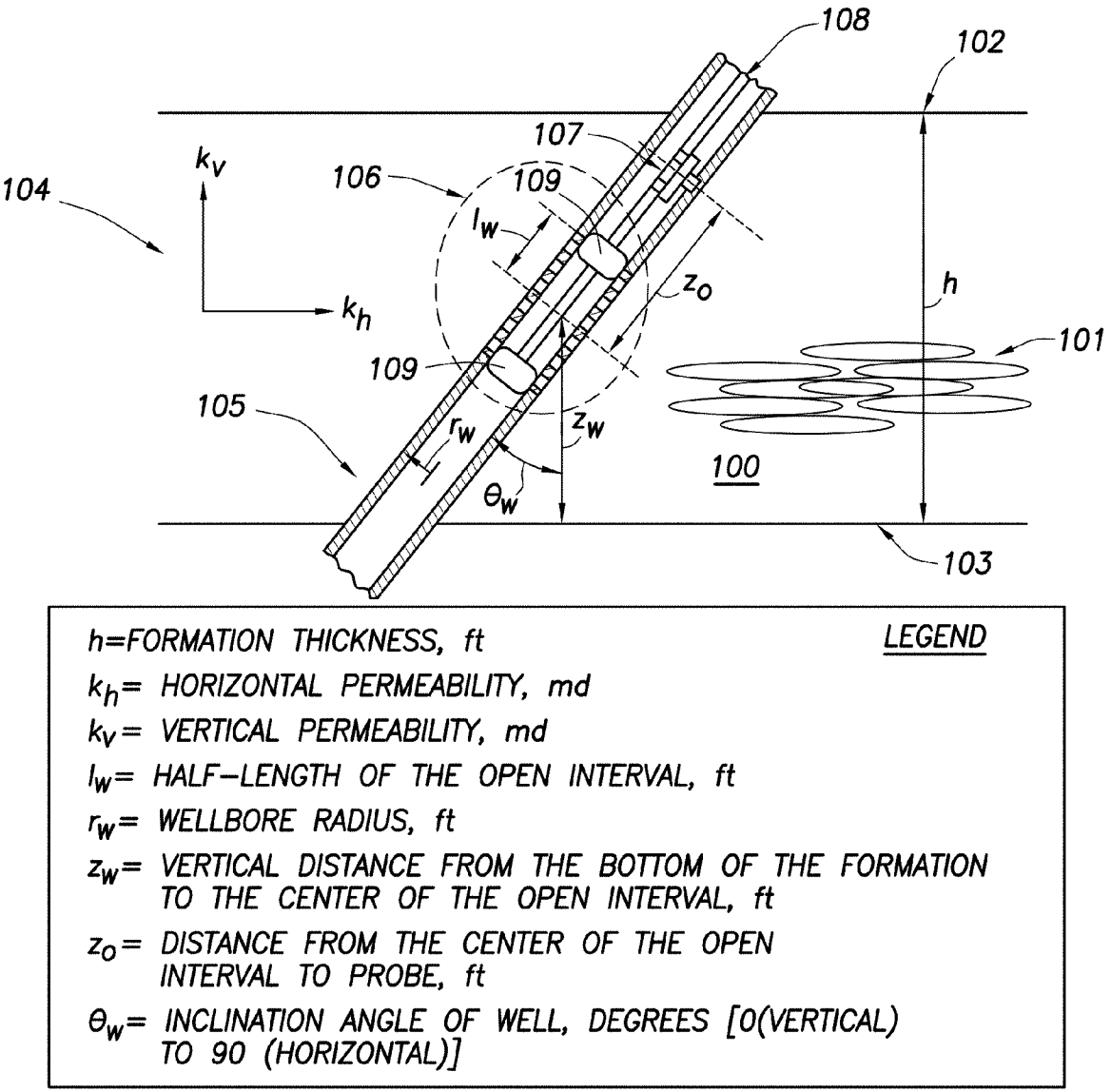
FIG. 1 depicts an earth formation penetrated by a wellbore and having an example wireline formation tester (WFT) for thickness-independent computation of horizontal and vertical permeability in accordance with one or more embodiments.

Embodiments are shown in the above-identified drawings and described below. In describing the embodiments, like or identical reference numerals are used to identify common or similar elements. The drawings are not necessarily to scale and certain features and certain views of the drawings may be shown exaggerated in scale or in schematic in the interest of clarity and conciseness.

In one or more embodiments of thickness-independent computation of horizontal and vertical permeability, a method using a straight-line analysis procedure for the estimation of horizontal and vertical permeability from pressure transient data at an observation probe, acquired by dual-packer-probe WFTs in single-layer systems is described. The analysis procedure is based on an analytical solution derived for the spherical flow regime, which is often exhibited by observation probe pressures acquired by packer-probe WFTs. The analytical solution may apply for all inclination angles of the wellbore, including vertical and horizontal wells, provided that a spherical flow regime is observed at the observation probe. The analysis procedure assumes that the values of the porosity-total compressibility product and fluid viscosity are known a priori; however, there is no requirement that formation thickness be known. It is understood that the analysis procedure does not require that a radial flow regime be observed at the dual-packer and observation probe. Therefore, both horizontal and vertical permeability can be estimated from an observation probe pressure data exhibiting spherical flow of packer-probe WFTs. The terms "horizontal permeability" and "vertical permeability" are commonly used in the oilfield industry to refer to permeability parameters parallel to the formation bed boundaries and perpendicular to the formation bed boundaries, respectively. However, if the formation bed boundaries are not actually horizontal, then "horizontal permeability" and "vertical permeability" will not actually be horizontal and vertical, respectively. Nevertheless, it is understood that the terms horizontal permeability and vertical permeability are used to refer to permeability parallel to the bed boundaries and perpendicular to the bed boundaries, respectively, throughout this document. Further, the horizontal permeability and vertical permeability may be associated with a formation layer, which has a specific thickness; however, the computation of the horizontal permeability and vertical permeability disclosed herein does not require knowledge of the parameters for formation layer thickness (i.e., the horizontal permeability and vertical permeability may be calculated independent of formation layer thickness). In a similar manner as "horizontal" and "vertical" permeability, a "vertical well" is considered to be a wellbore drilled perpendicular to the formation bed boundaries, while a "horizontal well" is considered to be a wellbore drilled parallel to the formation bed boundaries. Thus, if the formation bed boundaries are not actually horizontal, then a "vertical well" and a "horizontal well" will not actually be vertical and horizontal, respectively.

The results of the analysis procedure give unique estimates of the individual values of horizontal and vertical permeability from an observation probe pressure data obtained along vertical and horizontal wellbores, but not from those obtained along slanted wellbores. For slanted well cases, the analysis procedure provides two possible solutions for the horizontal and vertical permeability. Hence, for slanted wellbores, a priori information on permeability from either core data or pretests is required to eliminate one of the solutions and identify the correct solution. In cases where transitional data from spherical flow to late-radial flow exist, nonlinear regression analysis based on history matching of dual-packer and/or observation probe pressure measurements from slanted wellbores may also help to check the validity of the two solutions as well as to estimate correct values of horizontal and vertical permeability. The analysis procedure also provides initial parameter estimates of horizontal and vertical permeability that can be further refined when nonlinear regression analysis of the dual-packer and probe pressure measurements is used for parameter estimation. The applicability of the analysis procedure is illustrated by two examples. The first example is based on a synthetic (i.e., simulated) packer-probe WFT data set and the second example is based on a field example.

In one or more embodiments, a dual-packer WFT is set against the formation and acts as the flow source. Pressure is monitored at both the packer interval and an observation probe. If there is a pressure drop at the probe due to production from the packer interval, this clearly indicates pressure communication between packer and probe locations. Interpretation of packer and probe data provides permeability in both the vertical and horizontal direction. Therefore, the near-wellbore heterogeneity may be resolved from such IPTT testing.

FIG. 1 depicts an earth formation penetrated by a wellbore (105) and having an example WFT for thickness-independent computation of horizontal and vertical permeability (104) in accordance with one or more embodiments. As shown in FIG. 1, the earth formation includes geological structures such as formation layer (100) with boundaries (102) and (103). Generally speaking, a formation layer may be a sandstone layer, limestone layer, shale layer, etc. Embodiments of thickness-independent computation of horizontal and vertical permeability may be practiced in a sandstone layer with sufficient porosity to form a reservoir. For example, the formation layer (100) includes elongated rock grains (101) disposed parallel to the formation layer boundaries (102) and (103). Accordingly, horizontal and vertical permeability (104) of the formation layer (100) are defined based on the orientation of the formation layer boundaries (102) and (103).

Further as shown in FIG. 1, the wellbore includes an interval (106) open to flow associated with a dual packer module (109). The dual packer module (109) and an observation probe (107) are attached to a wireline (108), which form the wireline formation tester (WFT) for performing interval pressure transient testing (IPTT). Although it is shown in FIG. 1 and described herein that the formation testing tool(s) are conveyed by wireline, the formation testing tool(s) may also be conveyed by drillpipe, coiled tubing, or any other means of conveyance used in the industry. IPTT performed for formation evaluation may have durations on the order of hours to investigate volumes within "tens of feet" radially and axially along the wellbore. More details of using the dual packer module (109) and the observation probe (107) to perform IPTT testing for determining horizontal and vertical permeability without knowledge of formation thickness h and within a short testing period prior to the onset of radial flow regime are described in reference to the following figures.

Figure 2:
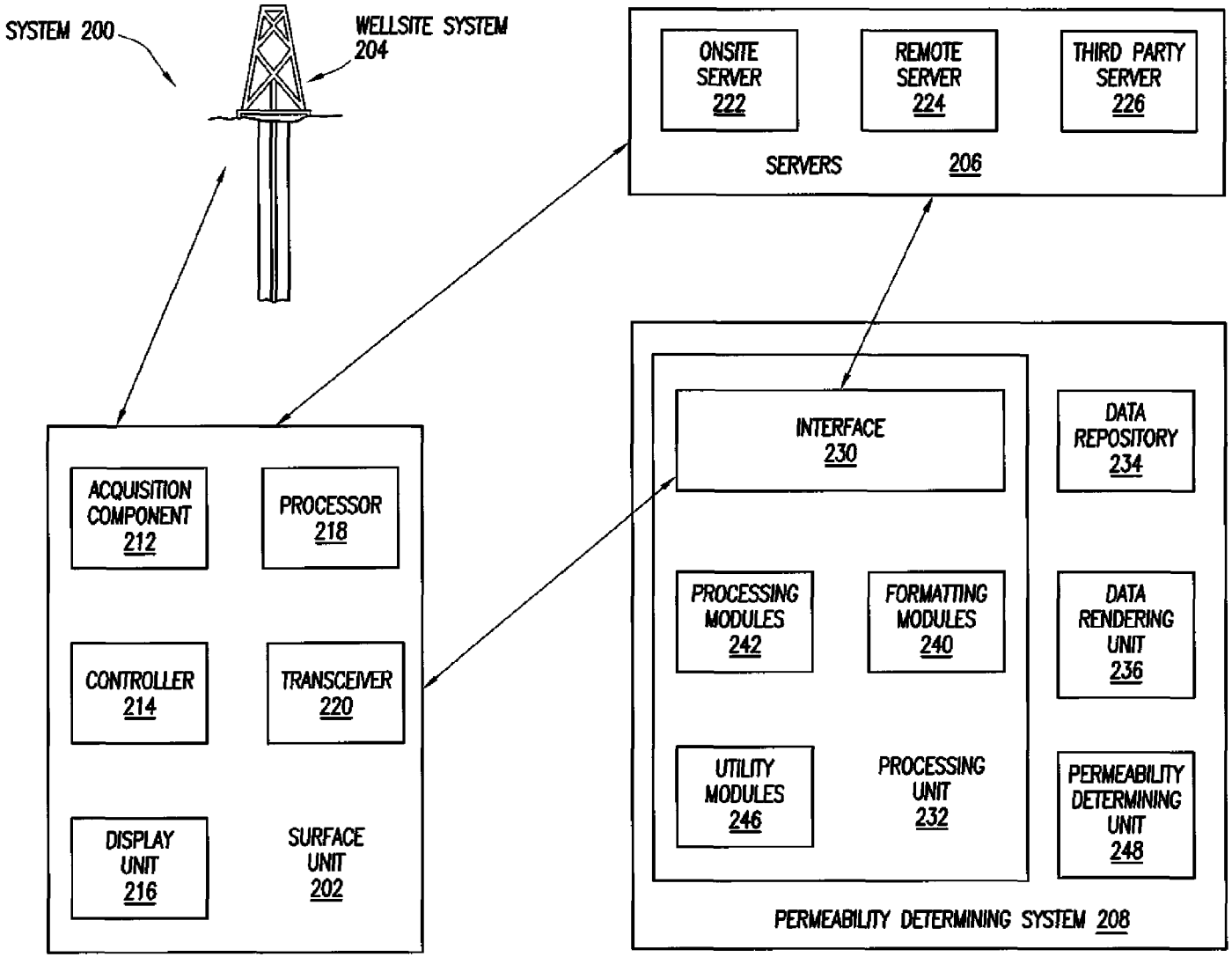
FIG. 2 depicts a system in which one or more embodiments of thickness-independent computation of horizontal and vertical permeability may be implemented.

FIG. 2 depicts a system (200) incorporated with a portion of a field, as shown and described above with respect to FIG. 1. As shown, the system (200) includes a surface unit (202) operatively connected to a wellsite system (204), servers (206), and a permeability determining system (208) via an interface (230) on the permeability determining system (208). The permeability determining system (208) is also operatively linked, via the interface (230), to the servers (206). The surface unit (202) and wellsite system (204) may include various field tools and wellsite facilities. As shown, communication links are provided between the surface unit (202) and the wellsite system (204), servers (206), and permeability determining system (208). A communication link is also provided between the permeability determining system (208) and the servers (206). A variety of links may be provided to facilitate the flow of data through the system (200). For example, the communication links may provide for continuous, intermittent, one-way, two-way and/or selective communication throughout the system (200). The communication links may be of any type, including but not limited to wired and wireless.

In one or more embodiments, the wellsite system (204) may be associated with a rig, a wellbore (e.g., wellbore (105) of FIG. 1), and other wellsite equipment and is configured to perform oilfield operations as described above. Specifically, the wellsite system (204) may be configured to perform operations (e.g., drilling, fracturing, production, or other oilfield operations) as directed by a surface unit (202). In one or more embodiments, the surface unit (202) is provided with an acquisition component (212), a controller (214), a display unit (216), a processor (218), and a transceiver (220). The acquisition component (212) collects and/or stores data of the field. This data may be measured by sensors at the wellsite. This data may also be received from other sources, such as those described with respect to FIG. 1 above.

The controller (214) may be enabled to enact commands at the field. The controller (214) may be provided with actuation means that can perform drilling operations, such as steering, advancing, etc., or otherwise taking action for other operations, such as fracturing, production, etc. at the wellsite. Commands may be generated based on logic of the processor (218), or by commands received from other sources. In one or more embodiments, the processor (218) is provided with functionality for manipulating and analyzing the data. The processor (218) may be provided with additional functionality to perform field operations.

In one or more embodiments, a display unit (216) may be provided at the wellsite and/or remote locations for viewing field data (not shown). The field data represented by the display unit (216) may be raw data, processed data and/or data outputs generated from various data. In one or more embodiments, the display unit (216) is adapted to provide flexible views of the data, so that the screens depicted may be customized as desired. A user may plan, adjust, and/or otherwise perform field operations (e.g., determine the desired course of action during field operations) based on reviewing the displayed field data. The field operations may be selectively adjusted in response to viewing the data on the display unit (216). The display unit (216) may include a two-dimensional (2D) display or a three-dimensional (3D) display for viewing field data or various aspects of the field operations.

In one or more embodiments, the transceiver (220) provides a means for providing data access to and/or from other sources. The transceiver (220) may also provide a means for communicating with other components, such as the servers (206), the wellsite system (204), the surface unit (202), and/or the permeability determining system (208).

The servers (206) may be configured to transfer data from a surface unit (202) at one or more wellsites to the permeability determining system (208). As shown, the servers (206) include an onsite server (222), a remote server (224), and a third party server (226). The onsite server (222) may be positioned at the wellsite and/or other locations for distributing data from the surface unit (202). As shown, the remote server (224) is positioned at a location away from the field and provides data from remote sources. The third party server (226) may be onsite or remote, but is often operated by a third party, such as a client.

In one or more embodiments, the servers (206) are capable of transferring data, such as logs, drilling events, trajectory, seismic data, historical data, economics data, other field data, and/or other data that may be of use during analysis. The type of server is not intended to limit thickness-independent computation of horizontal and vertical permeability. In one or more embodiments, the system is adapted to function with any type of server that may be employed.

In one or more embodiments, the servers (206) communicate with the permeability determining system (208) through the communication links. As indicated by the multiple arrows, the servers (206) may have separate communication links with the permeability determining system (208) and the surface unit (202). One or more of the servers (206) may be combined or linked to provide a combined communication link.

In one or more embodiments, the servers (206) collect a wide variety of data. The data may be collected from a variety of channels that provide a certain type of data, such as well logs and other acoustic measurement profiles. The data from the servers is passed to the permeability determining system (208) for processing. The servers (206) may also be configured to store and/or transfer data. For example, the data may be collected at the wellsite system (204) using measurements-while-drilling (MWD) tools, logging-while-drilling (LWD) tools, wireline tools, any other similar types of measurement tools, or any combination thereof. More specifically, the MWD tools, LWD tools, and/or wireline tools may be configured to obtain information related to fluid pressure and flow rate of the wellbore and the formation during a drilling, fracturing, or logging operation of the wellbore at the wellsite system (204).

For example, a wireline log is a continuous measurement of formation properties with electrically powered instruments to infer properties and make decisions about drilling and production operations. The record of the measurements, typically on a long strip of paper, may also be referred to a log. Measurements obtained by a wireline tool may include fluid pressure and flow rate data. In one or more embodiments, the wireline tool used for thickness-independent computation of horizontal and vertical permeability includes a dual packer tool module and an observation probe as described in reference to FIG. 1 above. Examples of fluid pressure and flow rate data obtained by the dual packer module and the observation probe are described in reference to FIGS. 4.1 and 5.1 below.

In another example, a MWD tool may be configured to evaluate physical properties during the drilling/fracturing of a wellbore, for example by obtaining magnetometer data and/or accelerometer data for determining the wellbore orientation. For example, a section of the wellbore may be vertical, horizontal, or slanted with respect to the formation layer.

In one or more embodiments, the permeability determining system (208) is operatively linked to the surface unit (202) for receiving data therefrom. In some cases, the permeability determining system (208) and/or server(s) (206) may be positioned at the wellsite. The permeability determining system (208) and/or server(s) (206) may also be positioned at various locations. The permeability determining system (208) may be operatively linked to the surface unit (202) via the server(s) (206). The permeability determining system (208) may also be included in or located near the surface unit (202).

In one or more embodiments, the permeability determining system (208) includes an interface (230), a processing unit (232), a data repository (234), a data rendering unit (236), and a permeability determining unit (248). In one or more embodiments, the permeability determining unit (248) may be configured to use downhole properties obtained by MWD tools, LWD tools, and/or wireline tools at the wellsite system (204) to identify a spherical flow regime for computing horizontal and vertical permeability. In this case, the downhole properties may be obtained from the servers (206), where the wellsite system (204) and surface unit (202) are configured to store the downhole properties in the servers (206) in real time.

In one or more embodiments, the permeability determining unit (248) may be configured to calculate horizontal permeability and/or vertical permeability of the formation. Specifically, the permeability determining unit (248) may be configured to process pressure data obtained by the observation probe, identify a spherical flow regime from the processed pressure data, calculate spherical permeability of the formation based on the spherical flow regime, and calculate horizontal permeability and vertical permeability of the formation. Further, in one or more embodiments, calculating the horizontal and vertical permeability may involve determining whether the wellbore section is vertical, horizontal, or slanted. More details of processing pressure data, identifying spherical flow regime, calculating spherical permeability, and calculating the horizontal/vertical permeability are discussed below with respect to FIGS. 3-5.3.

In one or more embodiments, the interface (230) of the permeability determining system (208) is configured to communicate with the servers (206) and the surface unit (202). The interface (230) may also be configured to communicate with other oilfield or non-oilfield sources. The interface (230) may be configured to receive the data and map the data for processing. In one or more embodiments, data from the servers (206) is sent along predefined channels, which may be selected by the interface (230).

As depicted in FIG. 2, the interface (230) selects the data channel of the server(s) (206) and receives the data. In one or more embodiments, the interface (230) also maps the data channels to data from the wellsite. The data may then be passed from the interface (230) to the processing modules (242) of the processing unit (232). In one or more embodiments, the data is immediately incorporated into the permeability determining system (208) for real time sessions and/or modeling. The interface (230) may create data requests (e.g., profiles, surveys, logs, MWD/LWD data, wireline data, etc.), display the user interface, and monitor connection state events. In one or more embodiments, the interface (230) also instantiates the data into a data object for processing.

In one or more embodiments, the processing unit (232) includes formatting modules (240), processing modules (242), and utility modules (246). These modules are configured to manipulate the field data for analysis, potentially in real time.

In one or more embodiments, the formatting modules (240) transform the data to a desired format for processing. Incoming data may be formatted, translated, converted, or otherwise manipulated for use. In one or more embodiments, the formatting modules (240) are configured to enable the data from a variety of sources to be formatted and used so that the data processes and displays in real time.

In one or more embodiments, the utility modules (246) provide support functions to the permeability determining system (208). In one or more embodiments, the utility modules (246) include a logging component (not shown) and a user interface (UI) manager component (not shown). The logging component provides a common call for the logging data, which allows the logging destination to be set by the application using the utility modules (246). The logging component may also be provided with other features, such as a debugger, a messenger, and a warning system, among others. The debugger sends a debug message to users of the system. The messenger sends information to subsystems, users, and others. The information sent by the messenger may or may not interrupt the operation and may be distributed to various locations and/or users throughout the system. The warning system may be configured to send error messages and warnings to various locations and/or users throughout the system. In some cases, the warning messages may interrupt the process and display alerts.

In one or more embodiments, the user interface (UI) manager component (not shown) creates user interface elements for displays. The UI manager component defines user input screens, such as menu items, context menus, toolbars, and settings windows. The UI manager may also be configured to direct events relating to these user input screens.

In one or more embodiments, the processing modules (242) are configured to analyze the data and generate outputs. As described above, the data analyzed by the processing modules (242) may include static data, dynamic data, historic data, real time data, or other types of data. Further, the data analyzed by the processing modules (242) may relate to various aspects of the field operations, such as formation structure, geological stratigraphy, core sampling, well logging, density, resistivity, fluid composition, flow rate, downhole condition, surface condition, equipment condition, or other aspects of the field operations. In one or more embodiments, the data is processed by the processing module (242) into multiple volume data sets for storage and retrieval.

In one or more embodiments, the data repository (234) stores the data for the permeability determining system (208). The data stored in the data repository (234) may be in a format available for use in real time (e.g., information is updated at approximately the same rate that the information is received). In one or more embodiments, the data is passed to the data repository (234) from the processing modules (242). The data can be persisted in the file system (e.g., as an extensible markup language (XML) file) or in a database. The user, a computer program, or some other determining entity may determine which storage is the most appropriate to use for a given piece of data and stores the data in a manner to enable automatic flow of the data through the rest of the system in a seamless and integrated fashion. The system may also facilitate manual and automated workflows (e.g., modeling, geological, and geophysical workflows) based upon the persisted data.

In one or more embodiments, the data rendering unit (236) performs rendering algorithm calculations to provide one or more displays for visualizing the data. The displays for visualizing the data may be presented, using one or more communication links, to a user at the display unit (216) of the surface unit (202). The data rendering unit (236) may contain a 2D canvas, a 3D canvas, a well section canvas, or other canvases, either by default or as selected by a user. The data rendering unit (236) may selectively provide displays composed of any combination of one or more canvases. The canvases may or may not be synchronized with each other during display. In one or more embodiments, the data rendering unit (236) is provided with mechanisms for actuating various canvases or other functions in the system. Further, the data rendering unit (236) may selectively provide displays composed of any combination of one or more volume data sets. The volume data sets typically contain exploration and production data.

While specific components are depicted and/or described for use in the units and/or modules of the permeability determining system (208), it will be appreciated that a variety of components with various functions may be configured to provide the formatting, processing, utility, and coordination functions necessary to process data in the permeability determining system (208). The components may have combined functionalities and may be implemented as software, hardware, firmware, or suitable combinations thereof.

Further, components (e.g., the processing modules (242), the data rendering unit (236), etc.) of the permeability determining system (208) may be located in an onsite server (222) or in distributed locations where a remote server (224) and/or a third party server (226) may be involved. The onsite server (222) may be located within the surface unit (202).

Figure 3:
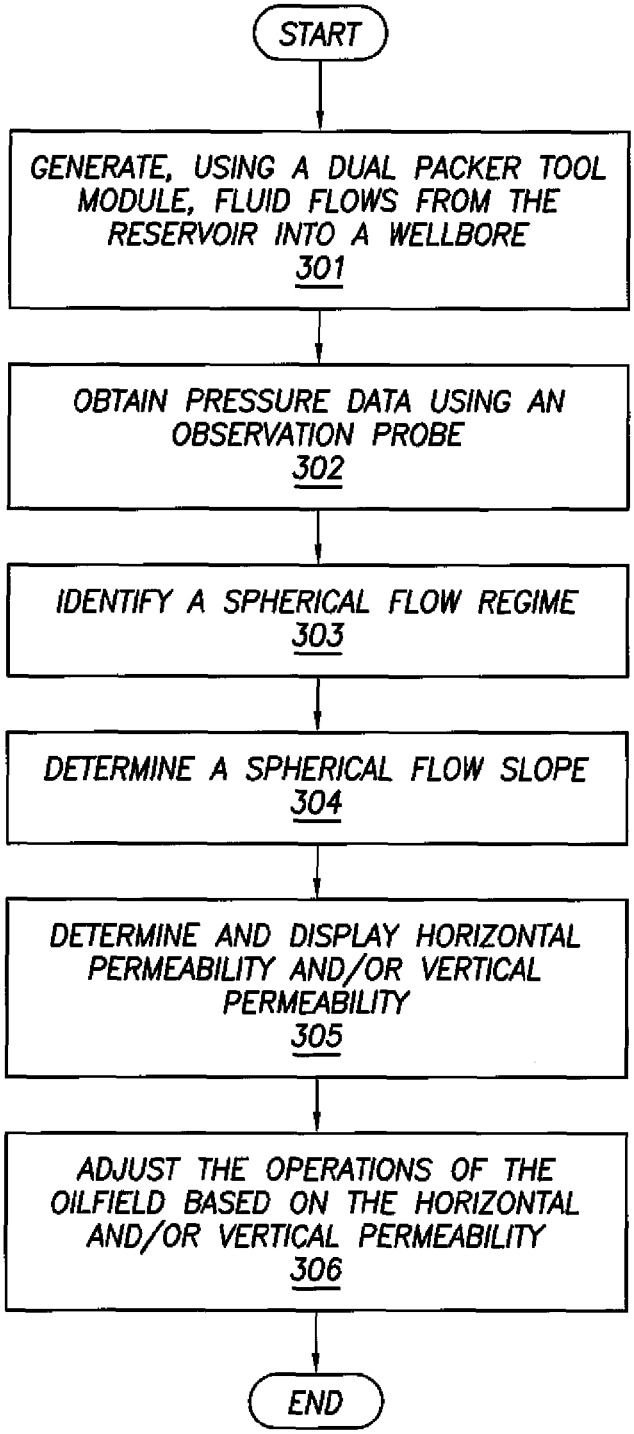
FIG. 3 depicts an example method for thickness-independent computation of horizontal and vertical permeability in accordance with one or more embodiments.

FIG. 3 depicts an example method for thickness-independent computation of horizontal and vertical permeability in accordance with one or more embodiments. For example, the method depicted in FIG. 3 may be practiced using the system (200) described in reference to FIG. 2 above for computing horizontal and vertical permeability of the formation layer (100) described in reference to FIG. 1 above. In one or more embodiments, one or more of the elements shown in FIG. 3 may be omitted, repeated, and/or performed in a different order. Accordingly, embodiments of thickness-independent computation of horizontal and vertical permeability should not be considered limited to the specific arrangements of elements shown in FIG. 3.

Initially in Element 301, fluid flows are generated from the reservoir into the dual packer wellbore interval using a dual packer module. In one or more embodiments, a drawdown operation and a shut-in operation are performed using a dual packer module to generate the fluid flows. In particular, fluids are drawn from the reservoir into the wellbore during the drawdown operation (i.e., production or fluid production) by maintaining a wellbore pressure lower than that of the formation. Subsequently, fluid flow is stopped for pressure to buildup back to the pressure in the formation during the shut-in operation (i.e., buildup period). In one or more embodiments, the flow rate is maintained as a constant during the drawdown operation. In one or more embodiments, multiple cycles of alternating drawdown and shut-in operations may be performed.

In Element 302, pressure data (i.e., IPTT data) associated with the fluid flows is obtained using an observation probe tool module. This tool module is disposed on the same formation testing tool (e.g., WFT) as the dual packer module. In one or more embodiments, the observation probe and the dual packer tool module are configured as described in reference to FIG. 1 above.

Generally speaking, interpretation of packer-probe IPTT data starts with an independent interpretation of the pressure data set. That is, the first step in the pressure transient analysis is flow regime identification, typically performed on pressure build-up data. Initial estimates of parameters such as spherical permeability can be obtained from a straight-line analysis. Secondly, other data, such as open hole logs, are added to the interpretation of the packer-probe IPTT data. Porosity and rock compressibility for the model are based on log data; fluid compressibility and viscosity are based on pressure/volume/temperature (PVT) analysis of fluid samples.

Specifically in Element 303, a portion of the pressure data is identified as corresponding to a spherical flow regime. Pressure data obtained during the drawdown operation may be subject to flow rate variations while pressure data obtained during the shut-in operation may be free of such dependencies. In one or more embodiments, pressure data obtained during the shut-in operation are used to identify the portion of pressure data corresponding to a spherical flow regime. For example, the spherical flow regime is identified based on a minus half slope line fitted to a time based plot of the pressure data. More details of identifying the spherical flow regime are described in reference to FIGS. 4.1-5.3 below.

In Element 304, a spherical flow slope is determined by analyzing the portion of the pressure data corresponding to the spherical flow regime. In one or more embodiments, a spherical superposition time scale is determined for the drawdown operation and the shut-in operation so that the portion of the pressure data corresponding to the spherical flow regime may be plotted versus the spherical superposition time scale to generate a spherical flow plot. In this case, the spherical flow slope is determined based on the spherical flow plot. More details of determining spherical flow slope are described in reference to FIGS. 4.1-5.3 below.

In Element 305, horizontal permeability and/or vertical permeability are determined and displayed. In one or more embodiments, spherical permeability is determined as an interim step prior to determining the horizontal permeability. In this case, vertical permeability is determined from the spherical and horizontal permeability. For example, the following equations may be used in determining the spherical and horizontal permeability.

$$k_s = \left(-\frac{2453q\mu\sqrt{\phi c_t \mu}}{m_{sp}}\right)^{2/3}$$

$$\frac{\sqrt{k_h k_v}\,(l_w')}{l_w} = \frac{141.2q\mu}{4l_w}\ln\left(\frac{z_o + l_w}{z_o - l_w}\right)\left(p^*_{ws,o} - p_o(t_p) - m_{sp}\frac{1}{\sqrt{t_p}}\right)^{-1}$$

where $m_{sp}$ represents the spherical flow slope, $k_s$ represents spherical permeability, $k_h$ represents the horizontal permeability, $k_v$ represents the vertical permeability, q represents flow rate, μ represents viscosity, ϕ represents porosity, and $c_t$ represents total compressibility, $l_w$ represents half length of the open interval of the dual packer tool module, $l_w'$ represents half length of the open interval of the dual packer tool module in an equivalent isotropic formation, $z_o$ represents a distance from a center of the open interval of the dual packer tool module to the observation probe, $p^*_{ws,o}$ represents an intercept of the spherical flow plot where the spherical superposition time scale is at zero value, $p_o$ represents formation pressure at the observation probe, and $t_p$ represents production time of the drawdown operation.

In one or more embodiments, when the dual packer interval and the observation probe are located within a section of the wellbore disposed in a vertical orientation with respect to the top and bottom formation boundaries of the reservoir, the following equation is also used to determine the horizontal permeability.

$$k_h = \left(\frac{\sqrt{k_h k_v}\,(l'_w)}{l_w}\right)$$

In one or more embodiments, when the dual packer interval and the observation probe are located within a section of the wellbore disposed in a horizontal orientation with respect to the top and bottom formation boundaries of the reservoir, the following equation is also used to determine the horizontal permeability.

$$k_h = \frac{(k_s)^3}{\left(\frac{\sqrt{k_h k_v}\,(l'_w)}{l_w}\right)^2}$$

In one or more embodiments, when the dual packer interval and the observation probe are located within a section of the wellbore disposed in a slanted orientation with respect to the top and bottom formation boundaries of the reservoir, the following equation is also used to determine the horizontal permeability.

$$k_h^3 - (\cos^2\theta_w)^{-1}\left(\frac{\sqrt{k_h k_v}\,(l'_w)}{l_w}\right)^2 k_h + (k_s)^3\frac{\sin^2\theta_w}{\cos^2\theta_w} = 0$$

where $\theta_w$ represents an inclination angle of the slanted section.

In one or more embodiments, vertical permeability is calculated based on the following equation.

$$k_v = \frac{(k_s)^3}{k_h^2}$$

More details of determining spherical, horizontal, and vertical permeability are described in reference to FIGS. 4.1-5.3 below.

Optionally, in Element 306, the operations of the oilfield are adjusted based on the horizontal and/or vertical permeability. For example, oilfield development decisions (e.g., drilling and/or completion decision) may be made based on the horizontal permeability. Further, vertical permeability may also be considered for adjusting the operations of the oilfield.

FIGS. 4.1, 4.2, 4.3, 5.1, 5.2, and 5.3 depict example pressure profiles for thickness-independent computation of horizontal and vertical permeability in accordance with one or more embodiments. Specifically, FIGS. 4.1, 4.2, and 4.3 are based on simulation results while FIGS. 5.1, 5.2, and 5.3 are based on field data. The following describes various equations used for analyzing the pressure data of FIGS. 4.1, 4.2, 4.3, 5.1, 5.2, and 5.3 to compute horizontal and vertical permeability.

An approximate constant flow rate spherical flow equation for an observation probe is described in "Pressure-Transient Analysis of Dual Packer-Probe Wireline Formation Testers in Slanted Wells," by Onur, M., Hegeman, P. S., and Kuchuk, F. J. (SPE 90250). Specifically, for any type of well (vertical, slanted, and horizontal well) the spherical flow equation is as the following.

$$p_i - p_o(t) = \frac{141.2q\mu}{2\sqrt{k_h k_v}\,(2l'_w)}\ln\left[\frac{z_o + l_w}{z_o - l_w}\right] - \frac{2453q\mu\sqrt{\phi c_t \mu}}{k_s^{3/2}}\frac{1}{\sqrt{t}} \tag{1}$$

$$k_s = (k_h^2 k_v)^{1/3} \tag{2}$$

$$l'_w = l_w\sqrt{(k_h/k_v)\cos^2\theta_w + \sin^2\theta_w} \tag{3}$$

In this equation, $p_i$ is the initial pressure at the probe location, $p_o$ is the measured observation pressure, q is the flow rate, $\mu$ is the viscosity, $k_s$ is the spherical permeability, $\phi$ is the porosity, and $c_t$ is the total compressibility.

For a slanted well during spherical flow in a buildup period following a constant flow rate drawdown period, the buildup equations for the observation probe are given as the following.

$$p_{ws,o}(\Delta t) = p_i - \frac{2453q\mu\sqrt{\phi c_i \mu}}{k_s^{3/2}}t_{bs} \tag{4}$$

$$p_{ws,o}(\Delta t) - p_o(t_p) = \frac{141.2q\mu}{4\sqrt{k_h k_v}\,(l'_w)}\ln\left[\frac{z_o + l_w}{z_0 - l_w}\right] - \frac{2453q\mu\sqrt{\phi c_t \mu}}{k_s^{3/2}}\left(\frac{1}{\sqrt{t_p}} + t_{bs}\right) \tag{5}$$

In Eqs. (4) and (5), $t_{bs}$ is the buildup spherical superposition time function defined as the following.

$$t_{bs} = \frac{1}{\sqrt{\Delta t}} - \frac{1}{\sqrt{t_p + \Delta t}}. \tag{6}$$

Eqs. (4) and (5) suggest that a plot of $p_{ws}$ vs. $t_{bs}$ will provide a straight line with slope $m_{sp}$ given by the following.

$$m_{sp} = -\frac{2453q\mu\sqrt{\phi c_t \mu}}{k_s^{3/2}} \tag{7}$$

Based on Eq. (7), the intercept at $t_{bs}=0$ is given by the following.

$$a_{1/\sqrt{t}=0} = p^*_{ws,o} \tag{8}$$

Thus, from slope $m_{sp}$, spherical permeability $k_s$ may be computed by using the following.

$$k_s = \left(-\frac{2453q\mu\sqrt{\phi c_t \mu}}{m_{sp}}\right)^{2/3} \tag{9}$$

It can be shown that from the intercept at $t_{bs}=0$ and using Eq. (5) with $t_{bs}=0$, the equation below is obtained.

$$\frac{\sqrt{k_h k_v}\,(l'_w)}{l_w} = \frac{141.2q\mu}{4l_w}\ln\left(\frac{z_o + l_w}{z_0 - l_w}\right)\left(p^*_{ws,o} - p_o(t_p) - m_{sp}\frac{1}{\sqrt{t_p}}\right)^{-1} \tag{10}$$

Note that $\sqrt{k_h k_v}(l'_w)$ is explicitly given in terms of $l_w$ and $k_h/k_v$ as the following.

$$\sqrt{k_h k_v}\,(l'_w) = \sqrt{k_h}\,l_w\sqrt{(k_h)\cos^2\theta_w + (k_v)\sin^2\theta_w} \tag{11}$$

Eq. (11) can be rearranged as the following.

$$\sqrt{k_h}\,\sqrt{(k_h)\cos^2\theta_w + (k_v)\sin^2\theta_w} = \frac{\sqrt{k_h k_v}\,(l'_w)}{l_w} \tag{12}$$

The other equation is obtained from spherical permeability as the following.

$$k_h\sqrt{k_v} = (k_s)^{3/2} \tag{13}$$

Eqs. (12) and (13) may be solved by applying the method of substitution to determine individual values of $k_h$ and $k_v$ from Eqs. (12) and (13) as the following.

(a) First, solve Eq. (13) for $k_h$ to obtain the following.

$$k_h = \frac{(k_s)^{3/2}}{\sqrt{k_v}} \tag{14}$$

(b) Then substitute this expression into Eq. (12) to obtain the following.

$$\sqrt{\frac{(k_s)^{3/2}}{\sqrt{k_v}}}\,\sqrt{\frac{(k_s)^{3/2}}{\sqrt{k_v}}\cos^2\theta_w + (k_v)\sin^2\theta_w} = \frac{\sqrt{k_h k_v}\,(l'_w)}{l_w} \tag{15}$$

Then a square is taken of each side to obtain the following.

$$\frac{(k_s)^{3/2}}{\sqrt{k_v}}\left[\frac{(k_s)^{3/2}}{\sqrt{k_v}}\cos^2\theta_w + (k_v)\sin^2\theta_w\right] = \left(\frac{\sqrt{k_h k_v}\,(l'_w)}{l_w}\right)^2 \tag{16}$$

or $$\left[\frac{(k_s)^3}{\sqrt{k_v}}\cos^2\theta_w + (k_s)^{3/2}\sqrt{k_v}\,\sin^2\theta_w\right] = \left(\frac{\sqrt{k_h k_v}\,(l'_w)}{l_w}\right)^2 \tag{17}$$

Note that Eq. (17) is nonlinear with respect to $k_v$. Then, the Newton-Raphson procedure, as is known to those skilled in the art, may be used to determine the positive root of Eq. (17) for $k_v$. Once $k_v$ is determined, either Eq. (12) or (13) may be used to solve for $k_h$.

A nonlinear equation in terms of $k_h$ may also be obtained as the following.

(a) First, solve Eq. 13 for $k_v$ as the following.

$$\sqrt{k_v} = \frac{(k_s)^{3/2}}{k_h} \Rightarrow k_v = \frac{(k_s)^3}{k_h^2} \tag{18}$$

(b) Then substitute this expression into Eq. 12 to obtain the following.

$$\sqrt{k_h}\,\sqrt{k_h\cos^2\theta_w + \frac{(k_s)^3}{k_h^2}\sin^2\theta_w} = \frac{\sqrt{k_h k_v}\,(l'_w)}{l_w} \tag{19}$$

Take square of both sides to obtain the following.

$$k_h\left(k_h\cos^2\theta_w + \frac{(k_s)^3}{k_h^2}\sin^2\theta_w\right) = \left(\frac{\sqrt{k_h k_v}\,(l'_w)}{l_w}\right)^2 \tag{20}$$

or $$\left[k_h^2\cos^2\theta_w + \frac{(k_s)^3}{k_h}\sin^2\theta_w\right] = \left(\frac{\sqrt{k_h k_v}\,(l'_w)}{l_w}\right)^2 \tag{21}$$

Note that Eq. (21) is nonlinear with respect to $k_h$. Then, the Newton-Raphson procedure, as is known to those skilled in the art may be used to determine the positive root(s) of Eq. (21) for $k_h$. Once $k_h$ is determined, either Eq. (12) or (13) may be used to solve for $k_v$.

Either Eq. (17) or Eq. (21) may be preferred. Here, Eq. (21) was chosen. Note that by multiplying both sides of Eq. (21) by $k_h$, the following may be obtained.

$$k_h^3\cos^2\theta_w + (k_s)^3\sin^2\theta_w = k_h\left(\frac{\sqrt{k_h k_v}\,(l'_w)}{l_w}\right)^2 \tag{22}$$

Eq. (22) may be rearranged as the following.

$$\cos^2\theta_w k_h^3 - \left(\frac{\sqrt{k_h k_v}\,(l'_w)}{l_w}\right)^2 k_h + (k_s)^3\sin^2\theta_w = 0. \tag{23}$$

Eq. (23) is a cubic equation, where existing analytical formulas may be used to compute the roots of the cubic equation. Eq. (23) may be solved for three different scenarios: a vertical well ($\theta_w$=0), a horizontal well ($\theta_w$=90), and slanted well associated with an angle $0<\theta_w<90$. In practice, a well may be determined to be vertical or horizontal within a tolerance of approximately 10 degrees.

For the vertical well case, assuming $\theta_w$=0 in Eq. (23) to obtain the following.

$$k_h^3 - \left(\frac{\sqrt{k_h k_v}\,(l'_w)}{l_w}\right)^2 k_h = 0 \tag{24}$$

or $$k_h^2 - \left(\frac{\sqrt{k_h k_v}\,(l'_w)}{l_w}\right)^2 = 0 \tag{25}$$

or $$k_h^2 = \left(\frac{\sqrt{k_h k_v}\,(l'_w)}{l_w}\right)^2 \tag{26}$$

or $$k_h\left(\frac{\sqrt{k_h k_v}\,(l'_w)}{l_w}\right). \tag{27}$$

Note that for this case, the right-hand side of Eq. (10) predicts $k_h$ because $$(l'_w) = l_w\sqrt{\frac{k_h}{k_v}}.$$

Once $k_h$ is determined, $k_v$ is computed using the computed $k_h$ value and the $k_s$ value estimated from spherical slope $m_{sp}$.

For the horizontal well case, assuming $\theta_w$=90 in Eq. (23) to obtain the following.

$$-\left(\frac{\sqrt{k_h k_v}\,(l'_w)}{l_w}\right)^2 k_h + (k_s)^3 = 0 \tag{28}$$

Solving for $k_h$ results in the following.

$$k_h = \frac{(k_s)^3}{\left(\frac{\sqrt{k_h k_v}\,(l'_w)}{l_w}\right)^2} \tag{29}$$

Note that $(l'_w)=l_w$ and $(k_s)^3=k_h^2k_v$. Once $k_h$ is determined, $k_v$ is computed using the computed $k_h$ value and the $k_s$ value estimated from spherical slope $m_{sp}$.

The slanted well case is considered as follows. For this case $0<\theta_w<90$, then Eq. (23) can be written as the following.

$$k_h^3 - (\cos^2\theta_w)^{-1}\left(\frac{\sqrt{k_h k_v}\,(l'_w)}{l_w}\right)^2 k_h + (k_s)^3\frac{\sin^2\theta_w}{\cos^2\theta_w} = 0. \tag{30}$$

From Eq. (30), the following may be defined.

$$\alpha = -(\cos^2\theta_w)^{-1}\left(\frac{\sqrt{k_h k_v}\,(l'_w)}{l_w}\right)^2 \tag{31}$$

$$\beta = (k_s)^3\frac{\sin^2\theta_w}{\cos^2\theta_w} \tag{32}$$

Eqs. (31) and (32) indicate that α is always negative, while β is always positive. Substituting Eqs. (31) and (32) into Eq. (30) results in the following.

$$k_h^3+\alpha k_h+\beta=0 \tag{33}$$

Eq. (33) is known as a "depressed" cubic equation in mathematical terms. The solution depends on the sign of the discriminant given by the following.

$$D = \frac{\alpha^3}{27} + \frac{\beta^2}{4} \tag{34}$$

D may be zero, greater than zero, or less than zero.

Case (a): For D>0, Eq. (33) has one real root and two imaginary roots. The imaginary roots are omitted because they are non-physical. The value of the real root is given by the following.

$$k_h = -\left(\sqrt{D} + \frac{\beta}{2}\right)^{1/3} + \frac{\alpha}{3\left(\sqrt{D} + \frac{\beta}{2}\right)^{1/3}}. \tag{35}$$

Noting that α is always negative, Eq. (35) indicates that $k_h$ is always negative for Case (a), which is not physically permissible.

Case (b): For D≦0, Eq. (33) has three real roots given by the following.

$$k_{h,1} = -2\sqrt{-\frac{\alpha}{3}}\cos\left(\frac{\gamma}{3}\right) \tag{36}$$

$$k_{h,2} = -2\sqrt{-\frac{\alpha}{3}}\cos\left(\frac{\gamma+2\pi}{3}\right) \tag{37}$$

$$k_{h,3} = -2\sqrt{-\frac{\alpha}{3}}\cos\left(\frac{\gamma+4\pi}{3}\right) \tag{38}$$

Noting that α is always negative, and based on the notation $\tilde{\alpha}=-\alpha$, Eqs. (36)-(38) become the following.

$$k_{h,1} = -2\sqrt{\frac{\tilde{\alpha}}{3}}\cos\left(\frac{\gamma}{3}\right) \tag{39}$$

$$k_{h,2} = -2\sqrt{\frac{\tilde{\alpha}}{3}}\cos\left(\frac{\gamma+2\pi}{3}\right) \tag{40}$$

$$k_{h,3} = -2\sqrt{\frac{\tilde{\alpha}}{3}}\cos\left(\frac{\gamma+4\pi}{3}\right) \tag{41}$$

In Eqs. (36)-(41), γ is computed from the following.

$$\gamma = \arccos\left(\frac{\beta}{2\sqrt{-\alpha^3/27}}\right) = \arccos\left(\frac{\beta}{2\sqrt{\tilde{\alpha}^3/27}}\right) \tag{42}$$

It is possible to obtain two positive roots from Eqs. (39)-(41). In this case, $k_h$ and $k_v$ values are not uniquely determined.

One or more embodiments of the invention are described below detailing example applications of the methods described above. The first example is a synthetic (simulated) example where the correct answers are therefore known, while the second example is an actual field example As noted above, FIGS. 4.1, 4.2, and 4.3 depict simulated pressure profiles for thickness-independent computation of horizontal and vertical permeability in accordance with one or more embodiments. Specifically, the "MDTLYR Test Design" program is used to simulate pressure vs. time for a constant-rate pressure test, using the parameters from Table 1. The drawdown period (i.e., 0-4 hours) and buildup period (i.e., 4-8 hours) are each 4 hours as indicated by the flow rate curve (403-1). A vertical well was used, and the formation thickness is set at a large value (i.e., h=100 ft, with dual packer centralized in the formation) to ensure spherical flow conditions. The simulated packer interval pressure curve (401-1) and probe pressure curve (402-1) are plotted using logarithmic scales in FIG. 4.1 as the pressure change from the initial reservoir pressure of 5000 psi.

TABLE 1

| Formation and fluid properties for mobility examples. | |
|---|---|
| Wellbore radius, $r_w$ | 0.354 ft |
| Packer interval half-length, $l_w$ | 1.6 ft |
| Horizontal permeability, $k_h$ | 10 md |
| Vertical permeability, $k_v$ | 2 md |
| Total compressibility, $c_t$ | $5 \times 10^{-5}$ l/psi |
| Viscosity, μ | 1 cp |
| Porosity, φ | 0.20 |
| Flow rate, q | 10 b/d |
| Skin, S | 3.0 |
| Wellbore storage, C | $6 \times 10^{-7}$ bbl/psi |

FIG. 4.2 shows the buildup portions of the packer interval pressure curve (401-1) and probe pressure curve (402-1) plotted using log/log scales as packer interval pressure curve for buildup (401-2) and probe pressure curve for buildup (402-2). Further, time derivatives for both packer interval pressure and probe pressure in the buildup period are plotted as (401-3) and (402-3), respectively. As shown, a spherical flow regime is observed/detected between 0.3 hour to 3 hour based on a minus half slope line (404-1) fitted to the packer interval pressure derivative curve (401-3) and/or the probe pressure derivative curve (402-3).

FIG. 4.3 shows the buildup portion of the probe pressure curve (402-1) plotted using spherical superposition time scale $t_{bs}$ as defined by Eq. (6) above to generate the spherical flow plot (402-4). A straight line (404-2) is fitted to the spherical flow plot (402-4) using spherical flow straight-line analysis, known to those skilled in the art, to obtain the straight-line slope $m_{sp}$ (i.e., spherical flow slope). In this example, the spherical flow slope $m_{sp}$ is estimated as −4.91 psi/sqrt (hour) from the straight-line analysis and spherical permeability $k_s$ is estimated as 6.3 md based on Eq. (7) above. The right-hand side of Eq. (10) is used to calculate horizontal permeability $k_h$ as 10.2 md. Once $k_h$ is computed, $k_v$ is computed as 2.4 md using Eq. (18) above. In this example, the $k_h$ and $k_v$ values agree very well with the input values shown in Table 1.

In this example, it is noted that there is no radial flow observed in the pressure test and $k_h$ is calculated/estimated without using formation thickness information. That is, $k_h$ may be estimated solely from the spherical flow equation using observation probe pressure data.

As noted above, FIGS. 5.1, 5.2, and 5.3 depict example pressure profiles for thickness-independent computation of horizontal and vertical permeability based on field data. Specifically, the example involves a packer probe in a drilled vertical well in a carbonate formation. In this example, it is assumed that viscosity is 2.3 cp, total compressibility is 1e-5 l/psi, and porosity is 0.21.

FIG. 5.1, which is drawn separately as FIGS. 5.1.1 and 5.1.2, shows the packer pressure curve (501-1) and the probe pressure curve (502-1), respectively. The flow period (i.e., drawdown period) identified by the flow rate curve (503-1) is approximately 1.3 hours (4680 sec.) and the build-up period is approximately 1.9 hours (6840 sec.).

FIG. 5.2 shows the buildup portions of the packer interval pressure curve (501-1) and probe pressure curve (502-1) plotted using log/log scales as packer interval pressure curve for buildup (501-2) and probe pressure curve for buildup (502-2). Further, time derivatives for both packer interval pressure and probe pressure in the buildup period are plotted as (501-3) and (502-3), respectively. As shown, a spherical flow regime is observed/detected between 0.3 hour to 0.8 hour based on a minus half slope line (504-1) fitted to the packer interval pressure derivative curve (501-3) and/or the probe pressure derivative curve (502-3).

FIG. 5.3 shows the buildup portion of the probe pressure curve (502-1) plotted using spherical superposition time scale $t_{bs}$ as defined by Eq. (6) above to generate the spherical flow plot (502-4). A straight line (504-2) is fitted to the spherical flow plot (502-4) using spherical flow straight-line analysis, known to those skilled in the art, to obtain the straight-line slope $m_{sp}$ (i.e., spherical flow slope). In this example, the spherical flow slope $m_{sp}$ is estimated as −1.33 psi/sqrt (hour) from the straight-line analysis and spherical permeability $k_s$ is estimated as 22.7 md based on Eq. (7) above. The right-hand side of Eq. (10) is used to calculate horizontal permeability $k_h$ as 22.1 md. Once $k_h$ is computed, $k_v$ is computed as 24 md using Eq. (18) above.

The radial flow regime is also observed in FIGS. 5.1, 5.2, and 5.3 between 0.8 hour and 1.9 hour for both probe pressure data and packer pressure data. In this case, horizontal permeability is estimated from radial flow analysis as 21.1 md by using a thickness of 71 ft that is obtained from open-hole log analysis. The horizontal permeability from both the spherical flow analysis (22.1 md) and the radial flow analysis (21.1 md) are in close agreement.

Although pressure data of the buildup period is used in the examples above to describe embodiments of thickness-independent computation of horizontal and vertical permeability, it is contemplated that variations of these embodiments may be applied using pressure data of the drawdown period. With the benefit of this disclosure, one skilled in the art will appreciate that various equations described above may be adapted for use with pressure data obtained during the drawdown operation to compute the thickness-independent horizontal and vertical permeability. For example, Eq. (10) may be rewritten for the drawdown period as the following, where $a_{1/\sqrt{t}=0}$ represents the intercept of the straight line on a spherical flow plot for a constant drawdown test.

$$\frac{\sqrt{k_h k_v}\,(l'_w)}{l_w} = \frac{141.2q\mu}{4l_w a_{1\sqrt{t}=0}} \ln\left(\frac{z_o + l_w}{z_o - l_w}\right) \tag{43}$$

Figure 6:
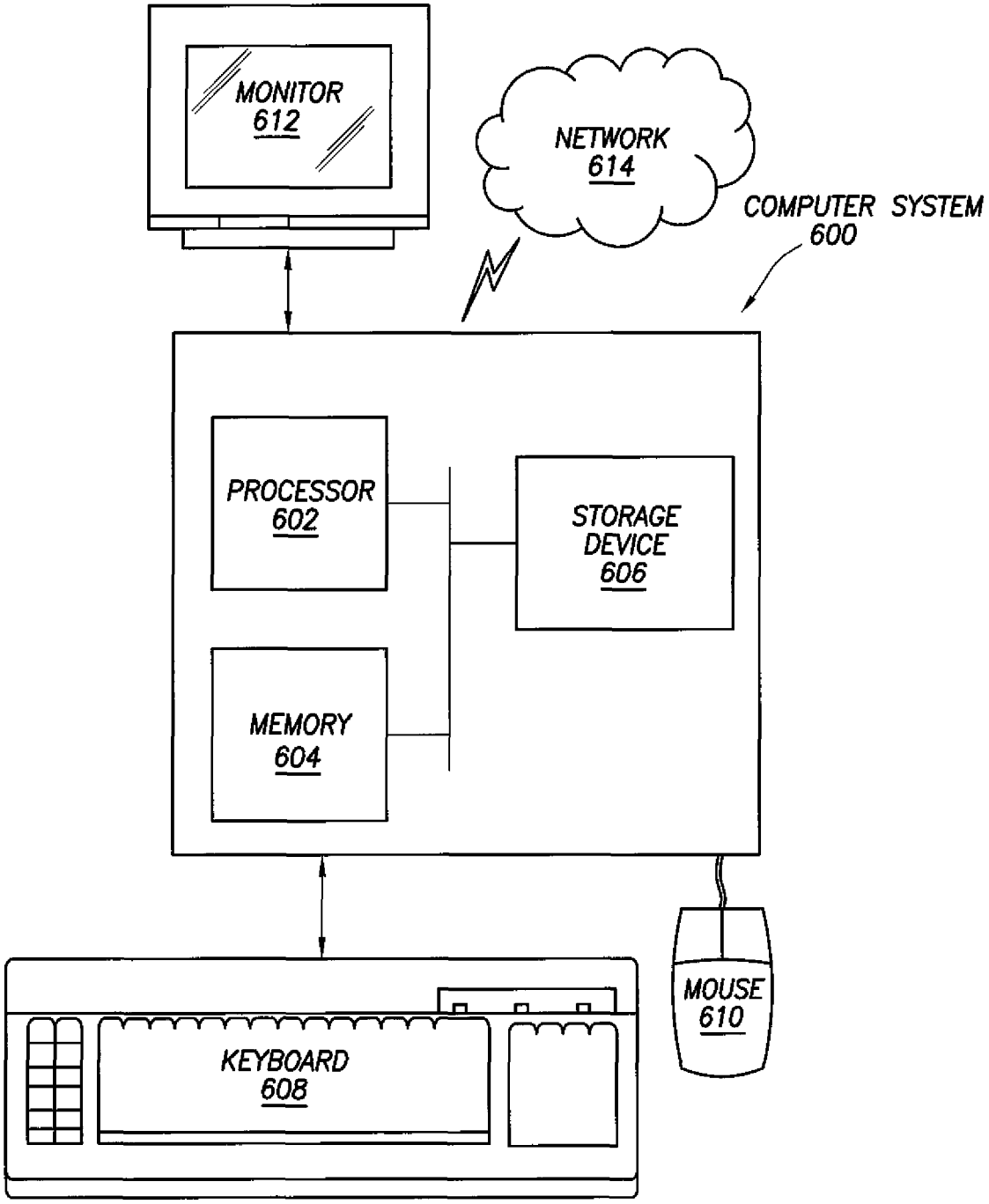
FIG. 6 depicts a computer system in which one or more embodiments of thickness-independent computation of horizontal and vertical permeability may be implemented.

Embodiments of thickness-independent computation of horizontal and vertical permeability may be implemented on virtually any type of computer regardless of the platform being used. For instance, as shown in FIG. 6, a computer system (600) includes one or more processor(s) (602) such as a central processing unit (CPU) or other hardware processor, associated memory (604) (e.g., random access memory (RAM), cache memory, flash memory, etc.), a storage device (606) (e.g., a hard disk, an optical drive such as a compact disk drive or digital video disk (DVD) drive, a flash memory stick, etc.), and numerous other elements and functionalities typical of today's computers (not shown). The computer (600) may also include input means, such as a keyboard (608), a mouse (610), or a microphone (not shown). Further, the computer (600) may include output means, such as a monitor (612) (e.g., a liquid crystal display LCD, a plasma display, or cathode ray tube (CRT) monitor). The computer system (600) may be connected to a network (614) (e.g., a local area network (LAN), a wide area network (WAN) such as the Internet, or any other similar type of network) via a network interface connection (not shown). Those skilled in the art will appreciate that many different types of computer systems exist (e.g., desktop computer, a laptop computer, a personal media device, a mobile device, such as a cell phone or personal digital assistant, or any other computing system capable of executing computer readable instructions), and the aforementioned input and output means may take other forms, now known or later developed. Generally speaking, the computer system (600) includes at least the minimal processing, input, and/or output means necessary to practice one or more embodiments.

Further, those skilled in the art will appreciate that one or more elements of the aforementioned computer system (600) may be located at a remote location and connected to the other elements over a network. Further, one or more embodiments may be implemented on a distributed system having a plurality of nodes, where each portion of the implementation (e.g., the direction tool, the servers) may be located on a different node within the distributed system. In one or more embodiments, the node corresponds to a computer system. Alternatively, the node may correspond to a processor with associated physical memory. The node may alternatively correspond to a processor with shared memory and/or resources. Further, software instructions to perform one or more embodiments may be stored on a computer readable medium such as a compact disc (CD), a diskette, a tape, or any other computer readable storage device.

The systems and methods provided relate to the acquisition of hydrocarbons from an oilfield. It will be appreciated that the same systems and methods may be used for performing subsurface operations, such as mining, water retrieval and acquisition of other underground fluids or other geomaterials from other fields. Further, portions of the systems and methods may be implemented as software, hardware, firmware, or combinations thereof.

While thickness-independent computation of horizontal and vertical permeability has been described with respect to a limited number of embodiments, those skilled in the art, having benefit of this disclosure, will appreciate that other embodiments may be devised which do not depart from the scope of thickness-independent computation of horizontal and vertical permeability as disclosed herein. Accordingly, the scope of thickness-independent computation of horizontal and vertical permeability should be limited only by the attached claims.

What is claimed is:

1. A method for determining permeability of a reservoir having a formation with a thickness using a packer-probe formation testing tool, comprising:

generating, using a dual packer tool module, fluid flows from the reservoir into a wellbore;

obtaining pressure data associated with the fluid flows using an observation probe tool module, wherein the packer-probe formation testing tool comprises the dual packer module and the observation probe tool module;

identifying a portion of the pressure data corresponding to a spherical flow regime;

generating, using the portion of the pressure data, a spherical flow plot of build-up probe pressure versus spherical build-up superposition time;

determining a spherical flow slope from the spherical flow plot;

determining horizontal permeability independent of the thickness of the formation based on the portion of the pressure data and the spherical flow slope; and displaying an output generated using the horizontal permeability.

2. The method of claim 1, wherein the pressure data is obtained during at least one selected from a group consisting of a drawdown operation and a shut-in operation.

3. The method of claim 1, further comprising:

identifying a minus half slope line in a plot of pressure derivative data, derived from the pressure data, versus time on a log-log scale, wherein the portion of the pressure data corresponding to the spherical flow regime is identified based on the minus half slope line.

4. The method of claim 1, wherein the pressure data are obtained during a shut-in operation subsequent to a drawdown operation, wherein determining the horizontal permeability based on the portion of the pressure data comprises equations of $$k_s = \left(-\frac{2453q\mu\sqrt{\phi c_t \mu}}{m_{sp}}\right)^{2/3},$$

$$\frac{\sqrt{k_h k_v}\,(l'_w)}{l_w} = \frac{141.2q\mu}{4l_w}\ln\left(\frac{z_o + l_w}{z_o - l_w}\right)\left(p^*_{ws,o} - p_o(t_p) - m_{sp}\frac{1}{\sqrt{t_p}}\right)^{-1},$$

where $m_{sp}$ represents the spherical flow slope, $k_s$ represents spherical permeability, $k_h$ represents the horizontal permeability, $k_v$ represents vertical permeability, q represents flow rate, $\mu$ represents viscosity, $\phi$ represents porosity, and $c_t$ represents total compressibility, $l_w$ represents half length of an open interval of the dual packer tool module, $l_w$ represents half length of the open interval of the dual packer tool module in an equivalent isotropic formation, $z_o$ represents a distance from a center of the open interval of the dual packer tool module to the observation probe tool module, $p^*_{ws,o}$ represents an intercept of the spherical flow plot where the spherical superposition time scale is at zero value, $p_o$ represents formation pressure at the observation probe tool module, and $t_p$ represents production time of the drawdown operation.

5. The method of claim 4, wherein determining the horizontal permeability based on the portion of the pressure data further comprises an equation of $$k_h = \left(\frac{\sqrt{k_h k_v}\,(l'_w)}{l_w}\right), \text{ and}$$

wherein the packer-probe formation testing tool is located within a section of the wellbore disposed in a vertical orientation with respect to a top formation boundary and a bottom formation boundary of the reservoir.

6. The method of claim 4, wherein determining the horizontal permeability based on the portion of the pressure data further comprises an equation of $$k_h = \frac{(k_s)^3}{\left(\frac{\sqrt{k_h k_v}\,(l'_w)}{l_w}\right)^2}, \text{ and}$$

wherein the packer-probe formation testing tool is located within a section of the wellbore disposed in a horizontal orientation with respect to a top formation boundary and a bottom formation boundary of the reservoir.

7. The method of claim 4, wherein determining the horizontal permeability based on the portion of the pressure data further comprises an equation of $$k_h^3 - (\cos^2\theta_w)^{-1}\left(\frac{\sqrt{k_h k_v}\,(l'_w)}{l_w}\right)^2 k_h + (k_s)^3\frac{\sin^2\theta_w}{\cos^2\theta_w} = 0$$

and wherein the packer-probe formation testing tool is located within a slanted section of the wellbore, wherein $\theta_w$ represents an inclination angle of the slanted section.

8. The method of claim 4, further comprising:

determining vertical permeability based on an equation of $$k_v = \frac{(k_s)^3}{k_h^2}.$$

9. A system for determining permeability of a reservoir having a formation with a thickness using a packer-probe formation testing tool, comprising:

a dual packer tool module, disposed on the packer-probe formation testing tool, for generating fluid flows from the reservoir into a wellbore;

an observation probe tool module, disposed on the packer-probe formation testing tool, for obtaining pressure data associated with the fluid flows;

a processor and memory storing instructions when executed by the processor comprising functionalities for:

identifying a portion of the pressure data corresponding to a spherical flow regime;

generating, using the portion of the pressure data, a spherical flow plot of build-up probe pressure versus spherical build-up superposition time;

determining a spherical flow slope from the spherical flow plot; and determining horizontal permeability independent of the thickness of the formation based on portion of the pressure data and the spherical flow slope; and a display unit configured to display an output generated using the horizontal permeability.

10. The system of claim 9, wherein the pressure data is obtained during at least one selected from a group consisting of a drawdown operation and a shut-in operation.

11. The system of claim 9, the instructions when executed by the processor further comprising functionalities for:

identifying a minus half slope line in a plot of pressure derivative data, derived from the pressure data, versus time on a log-log scale, wherein the portion of the pressure data corresponding to the spherical flow regime is identified based on the minus half slope line.

12. The system of claim 9, wherein the pressure data are obtained during a shut-in operation subsequent to a drawdown operation, wherein determining the horizontal permeability based on the portion of the pressure data comprises equations of $$k_s = \left(-\frac{2453q\mu\sqrt{\phi c_t \mu}}{m_{sp}}\right)^{2/3},$$

$$\frac{\sqrt{k_h k_v}\,(l'_w)}{l_w} = \frac{141.2q\mu}{4l_w}\ln\left(\frac{z_o + l_w}{z_o - l_w}\right)\left(p^*_{ws,o} - p_o(t_p) - m_{sp}\frac{1}{\sqrt{t_p}}\right)^{-1},$$

where $m_{sp}$ represents the spherical flow slope, $k_s$ represents spherical permeability, $k_h$ represents the horizontal permeability, $k_v$ represents vertical permeability, q represents flow rate, $\mu$ represents viscosity, $\phi$ represents porosity, and $c_t$ represents total compressibility, $l_w$ represents half length of the open interval of the dual packer tool module, $l_w$ represents half length of the open interval of the dual packer tool module in an equivalent isotropic formation, $z_o$ represents a distance from a center of the open interval of the dual packer tool module to the observation probe tool module, $p^*_{ws,o}$ represents an intercept of the spherical flow plot where the spherical superposition time scale is at zero value, $p_o$ represents formation pressure at the observation probe tool module, and $t_p$ represents production time of the drawdown operation.

13. The system of claim 12, wherein determining the horizontal permeability based on the portion of the pressure data further comprises an equation of $$k_h = \left(\frac{\sqrt{k_h k_v}\,(l'_w)}{l_w}\right), \text{ and}$$

wherein the packer-probe formation testing tool is located within a section of the wellbore disposed in a vertical orientation with respect to a top formation boundary and a bottom formation boundary of the reservoir.

14. The system of claim 12, wherein determining the horizontal permeability based on the portion of the pressure data further comprises an equation of $$k_h = \frac{(k_s)^3}{\left(\frac{\sqrt{k_h k_v}\,(l'_w)}{l_w}\right)^2}, \text{ and}$$

wherein the packer-probe formation testing tool is located within a section of the wellbore disposed in a horizontal orientation with respect to a top formation boundary and a bottom formation boundary of the reservoir.

15. The system of claim 12, wherein determining the horizontal permeability based on the portion of the pressure data further comprises an equation of $$k_h^3 - (\cos^2\theta_w)^{-1}\left(\frac{\sqrt{k_h k_v}\,(l'_w)}{l_w}\right)^2 k_h + (k_s)^3\frac{\sin^2\theta_w}{\cos^2\theta_w} = 0$$

and wherein the packer-probe formation testing tool is located within a slanted section of the wellbore, wherein $\theta_w$ represents an inclination angle of the slanted section.

16. The system of claim 12, the instructions when executed by the processor further comprising functionalities for:

determining vertical permeability based on an equation of $$k_v = \frac{(k_s)^3}{k_h^2}.$$

17. A non-transitory computer readable medium storing instructions for determining permeability of a reservoir having a formation with a thickness using a packer-probe formation testing tool, the instructions when executed causing a processor to:

generate, using a dual packer tool module, fluid flows from the reservoir into a wellbore;

obtain pressure data associated with the fluid flows using an observation probe tool module, wherein the packer-probe formation testing tool comprises the dual packer module and the observation probe tool module;

identify a portion of the pressure data corresponding to a spherical flow regime;

generate, using the portion of the pressure data, a spherical flow plot of build-up probe pressure versus spherical build-up superposition time;

determine a spherical flow slope from the spherical flow plot;

determine horizontal permeability independent of the thickness of the formation based on the portion of the pressure data and the spherical flow slope; and display an output generated using the horizontal permeability.

* * * * *